US009155926B2

(12) United States Patent
Mason

(10) Patent No.: US 9,155,926 B2
(45) **Date of Patent: *Oct. 13, 2015**

(54) DRAIN NOZZLE

(76) Inventor: Thomas E. Mason, Washington, IN (US)

( * ) Notice: Subject to any disclaimer, the term of this patent is extended or adjusted under 35 U.S.C. 154(b) by 652 days.

This patent is subject to a terminal disclaimer.

(21) Appl. No.: 12/925,037

(22) Filed: Oct. 12, 2010

(65) Prior Publication Data

US 2011/0083863 A1 Apr. 14, 2011

Related U.S. Application Data

(60) Provisional application No. 61/278,877, filed on Oct. 13, 2009.

(51) Int. Cl.

| | |
|---|---|
| ***A62C 3/00*** | (2006.01) |
| ***A62C 31/03*** | (2006.01) |
| ***B05B 1/26*** | (2006.01) |
| ***A62C 31/12*** | (2006.01) |

(52) U.S. Cl.

CPC ..... *A62C 31/03* (2013.01); *A62C 31/12* (2013.01); *B05B 1/265* (2013.01)

(58) Field of Classification Search

CPC ..... A62C 31/12; A62C 31/03; A62C 31/005; A62C 35/00; B05B 1/30; B05B 1/265

USPC ..... 239/201, 208, 273, 451–453, 456, 457, 239/459, 202–204, 504; 169/54, 46

See application file for complete search history.

(56) References Cited

U.S. PATENT DOCUMENTS

| | | | | |
|---|---|---|---|---|
| 1,472,669 | A * | 10/1923 | Overbaugh | 239/451 |
| 1,962,824 | A | 6/1934 | Lindquist | |
| 2,582,527 | A * | 1/1952 | Burnett | 239/452 |
| 3,408,006 | A * | 10/1968 | Stanwood | 239/66 |
| 5,501,282 | A * | 3/1996 | Sundholm | 169/37 |
| 6,182,767 | B1 | 2/2001 | Jackson | |
| 6,264,117 | B1 * | 7/2001 | Roman | 239/451 |
| 6,371,212 | B1 * | 4/2002 | Jackson | 169/37 |
| 2002/0179739 | A1 * | 12/2002 | Kunkle et al. | 239/453 |

* cited by examiner

*Primary Examiner* — Jason Boeckmann
(74) *Attorney, Agent, or Firm* — Sue Z. Shaper

(57) ABSTRACT

A drain nozzle for fire fighting including a nozzle barrel and bafflehead, a floor grating providing the bafflehead, the nozzle barrel adjustably attached by an adjustment ring to the grating, the nozzle barrel not touching the bafflehead, the grating and bafflehead directing the discharge into an appropriate pattern.

19 Claims, 9 Drawing Sheets

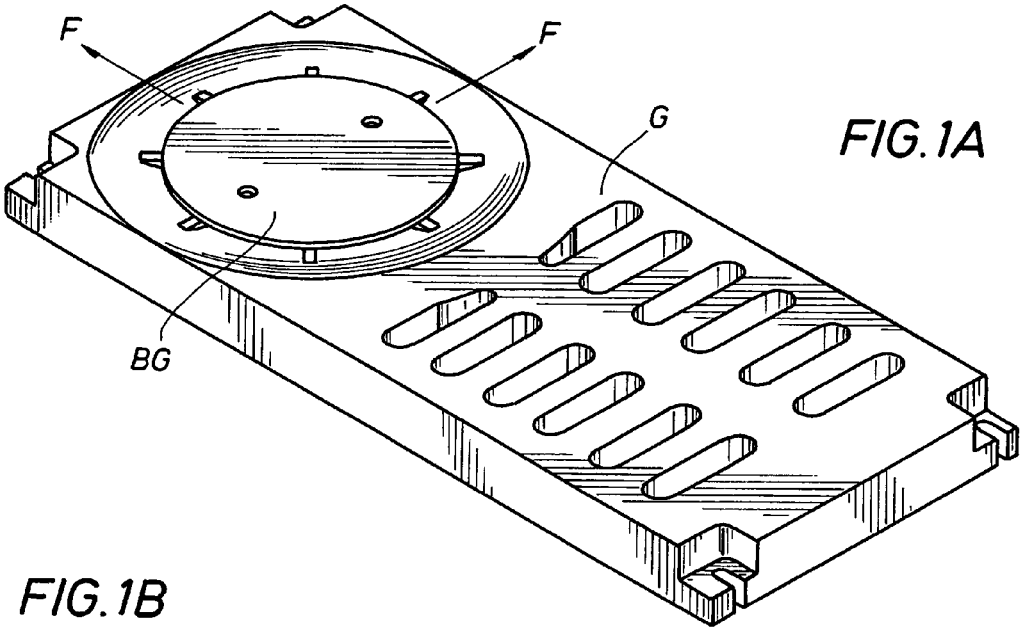
FIG.1A
FIG.1B
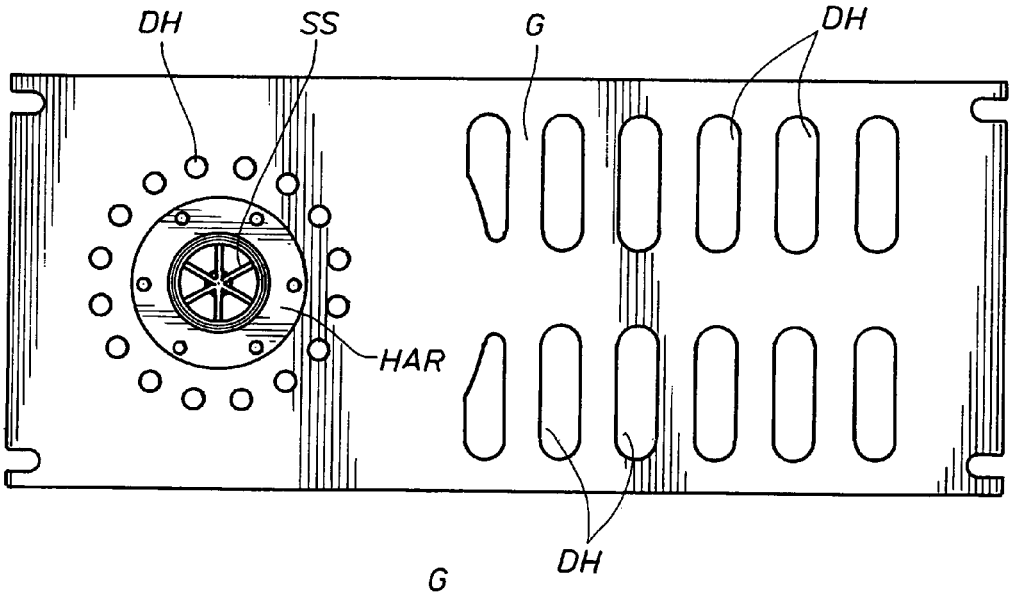
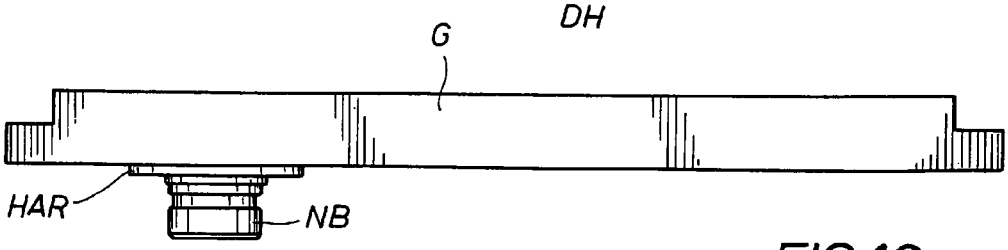
FIG.1C

FIG. 3D
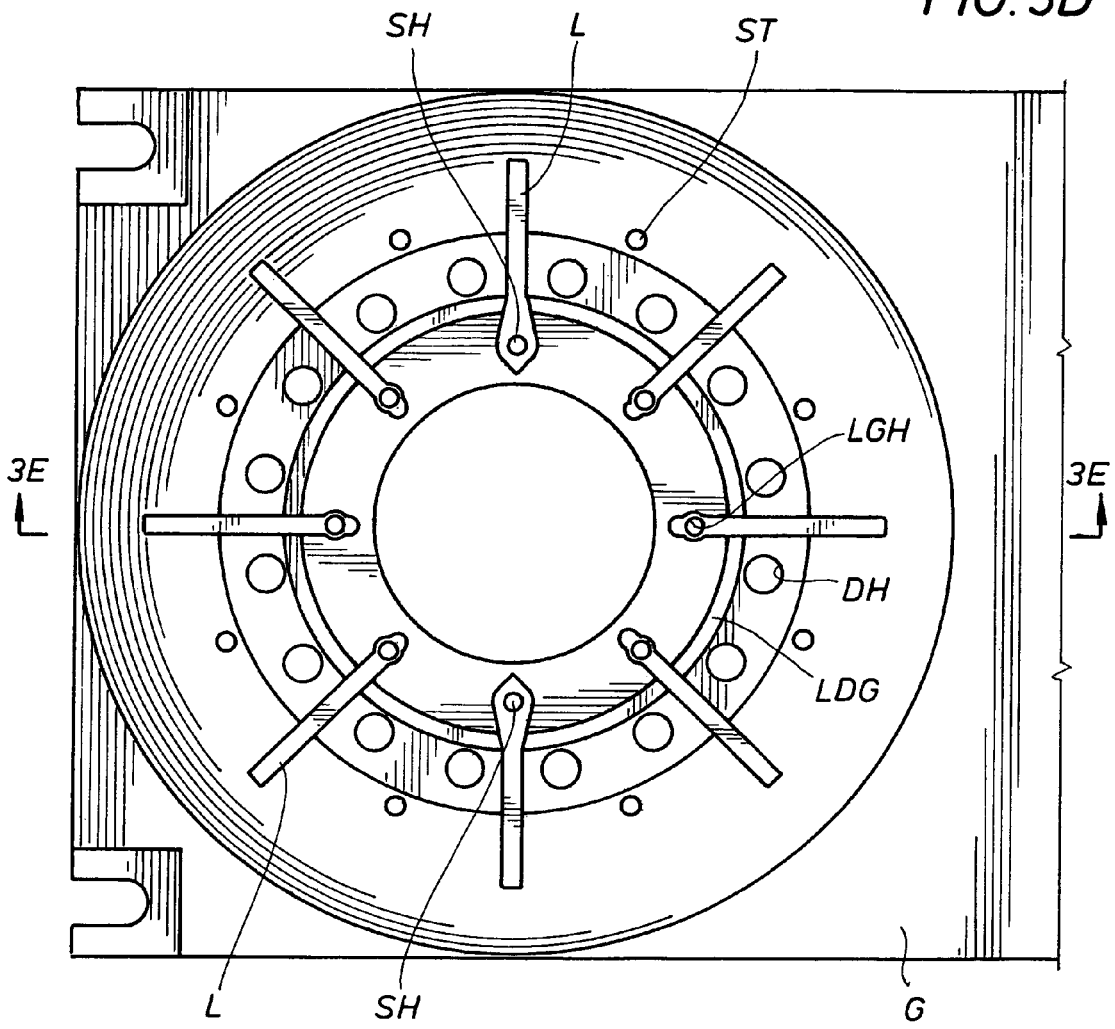
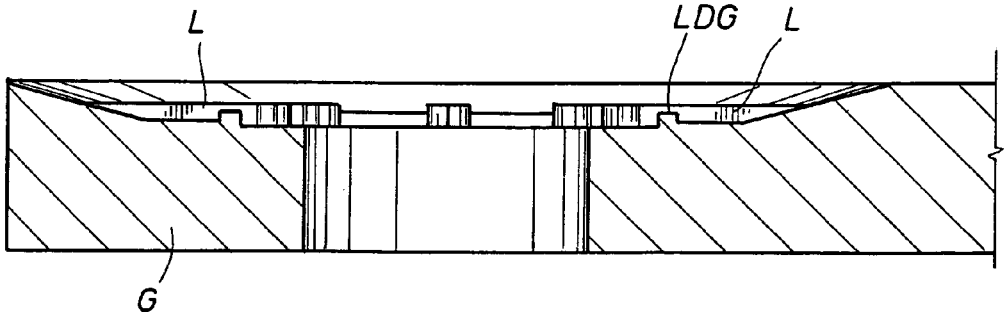
FIG. 3E

BG
SH
SH

BG
LG
LG

LG
BG
LG

SH
SH

LG
LG

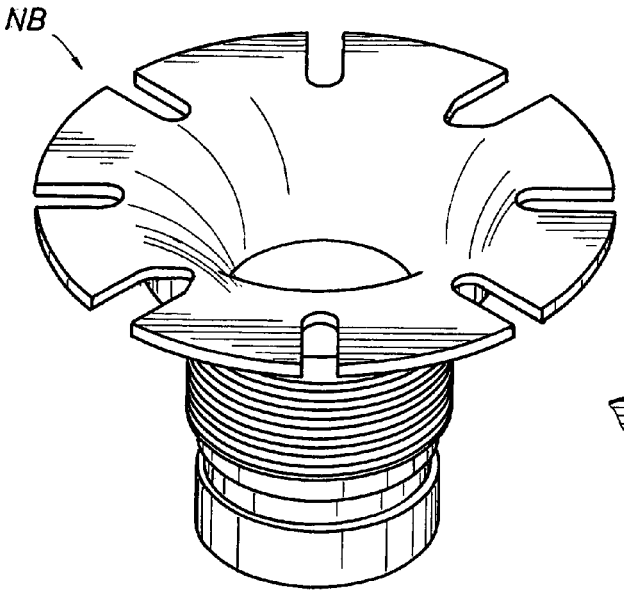
FIG. 5A
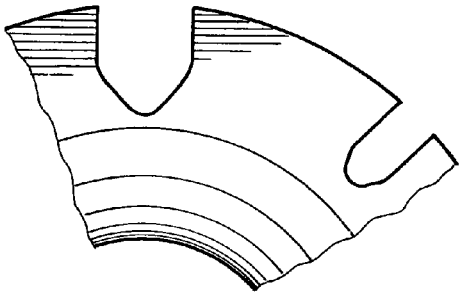
FIG. 5E
FIG. 5B
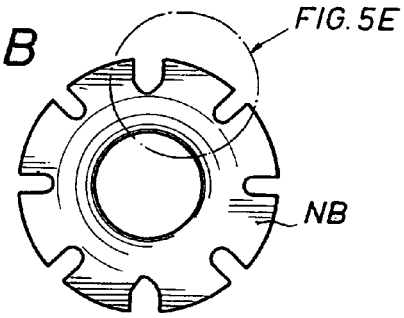
FIG. 5D
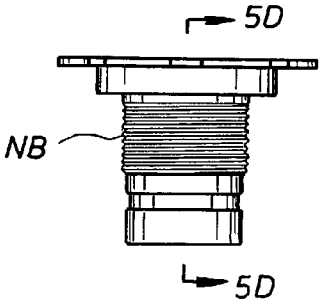
FIG. 5C
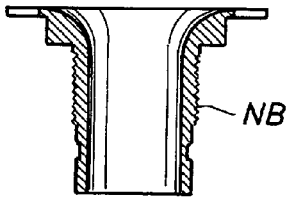

FIG. 7A
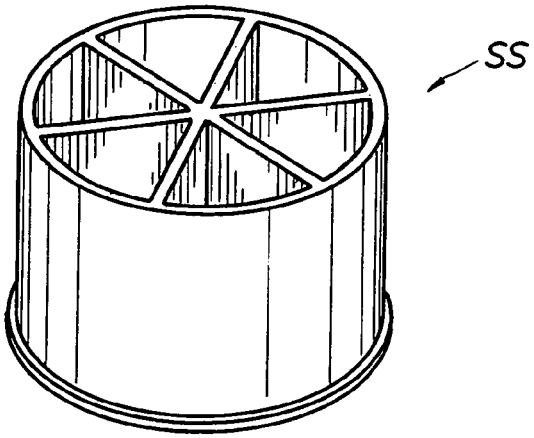
FIG. 7C
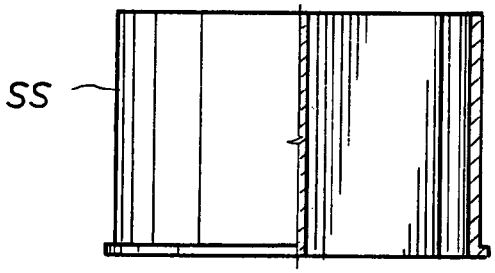
FIG. 7B
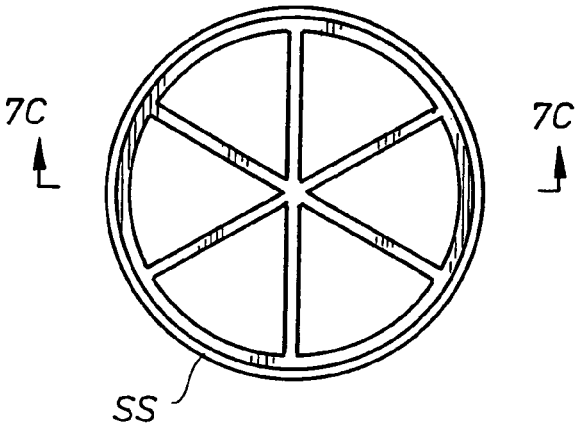
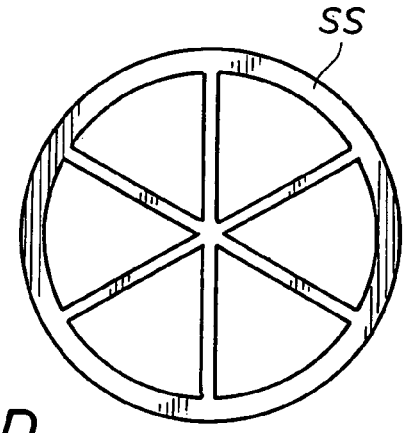
FIG. 7D

DRAIN NOZZLE

CROSS REFERENCE TO RELATED APPLICATIONS

The instant application is related to and claims priority to provisional application 61/278,877, filed Oct. 13, 2009, entitled Improved Drain Nozzle, inventor Thomas E. Mason. The above referenced application Ser. No. 61/278,877 is herein and hereby incorporated by reference in its entirety.

FIELD OF THE INVENTION

This invention relates to firefighting nozzles and more particularly to firefighting nozzles suitable for location in a floor, in particular in a floor drain of an industrial facility such as an aircraft hangar or the like. The invention includes coordinating floor gratings. The grating and bafflehead portion of the grating shape the discharge, as per the need of the facility.

BACKGROUND OF THE INVENTION

The two patents, U.S. Pat. No. 6,182,767 and U.S. Pat. No. 6,371,212 as well as their references, form a background for the instant invention. The embodiments disclosed herein, for the instant improved drain nozzle, comprise a novel improved approach for the design of drain nozzles in general, improving on the capacity of a drain nozzle to bear weight and to shape and discharge foam.

Drain nozzles are structured to be stationed in trenches in the floor of a facility, covered by a grating. Thus the nozzle and grating system must be able to withstand any traffic of the area, such as an aircraft or other equipment rolling over or sitting upon the grating. Further, in the event of a body blocking portions of discharge from a drain nozzle and grating, adequate drainage should be provided such that the foam supply pressure at other nozzles on the foam supply line is not significantly impacted.

Other design requirements for drain nozzles vary with the facility to be protected. A drain nozzle to be used in an aircraft hangar, for instance, typically is subject to one requirement that the nozzle discharge foam a given distance, such as 20 feet, laterally for 360 degrees, without discharging the foam more than one or two feet in height. The purpose of this requirement is to avoid destroying or harming expensive equipment in the hangar with the foam.

The instant inventive design proposes to satisfy the above requirements in an improved manner.

SUMMARY OF THE INVENTION

One preferred embodiment of the invention comprises a drain nozzle for fire fighting in a hangar or the like, and preferably includes the feature that the floor grating provides the bafflehead for the nozzle, without touching the nozzle barrel. A nozzle barrel is preferably adjustably attached to a height adjustment ring, itself attached to the floor grating. The nozzle barrel itself does not touch the bafflehead or the grating. The bafflehead and nozzle barrel define an adjustable annular discharge gap with an adjustable k-factor therebetween, by virtue of the ability to adjust the height of the barrel with respect to the grating and bafflehead by the ring. Alternately, the adjustable barrel could be biased with respect to the bafflehead/grating by the height adjustment ring so as to provide a "pressure regulating" nozzle.

BRIEF DESCRIPTION OF THE DRAWINGS

A better understanding of the present invention can be obtained when the following detailed description of the preferred embodiments are considered in conjunction with the following drawings, in which:

FIGS. 1A-1F illustrate an assembly of a preferred embodiment of the instant invention, a aircraft hangar drain nozzle, including perspective, bottom, side, top, side cut-away and a side cut-away detail views, respectively.

FIGS. 3A-3E provide views of the grating of the nozzle of FIG. 1, with the bafflehead portion of the grating removed, including top, side, bottom, top detail and side detail cut-away views, respectively.

FIGS. 5A-5E illustrate the nozzle barrel or body of the embodiment of FIG. 1, in perspective, top, side, top detail and side cutaway views, respectively.

FIGS. 7A-7D illustrate a stream straightener of the embodiment of FIG. 1, in perspective, top, cut-away and bottom views, respectively.

The drawings are primarily illustrative. It would be understood that structure may have been simplified and details omitted in order to convey certain aspects of the invention. Scale may be sacrificed to clarity.

DESCRIPTION OF THE PREFERRED EMBODIMENTS

The embodiments of the figures generally reflect a preferred drain nozzle where a bafflehead BG for a nozzle is integrated into, and provided by, a portion of a floor grating G. A nozzle body or barrel NB is adjustably attached to a height adjustment ring HAR that is, preferably, attached to the bottom of the floor grating. The grating provides an opening NO for the nozzle body. In preferred embodiments the nozzle body does not touch the floor grating or the bafflehead.

A source of firefighting fluid is carried through a trench, not shown, located under the floor grating, to the nozzle barrel NB. A hose or line couples to the nozzle body at line coupler LC on the nozzle barrel, in a manner known to the art.

The bafflehead BG and the floor grating G in combination direct firefighting fluid. In the preferred embodiment illustrated the fluid is directed predominantly laterally. A design objective for an aircraft hangar is to direct the fire fighting foam discharge 20 feet radially with the foam rising no more than a foot or two vertically from the floor. The purpose of such distribution pattern is to protect equipment standing on the floor while addressing the fire hazard.

The floor grating, including the bafflehead, is constructed of material having a strength sufficient to support the weight of anticipated vehicles or equipment traveling thereover, such as aircraft.

Drainage ports DH are provided in the grating in general and, in particular under the bafflehead. If the annular discharge area around the bafflehead is obstructed, as by a vehicle tire for instance, fluid should still pass through the nozzle and back through the grating through drainage ports DH under the bafflehead into the trench, thereby avoiding a significant effect on supply pressure.

Preferably spacing S and gap GP between the nozzle body and the bafflehead are adjustable, as by a height adjustment ring HAR, in order to be able to adjust the k-factor of the nozzle. Alternately, the spacing could be bias controlled to regulate pressure.

In all embodiments it is preferred for a portion of the grating to be removable in order to provide access from the top to the nozzle and associated lines.

Figure 1D:
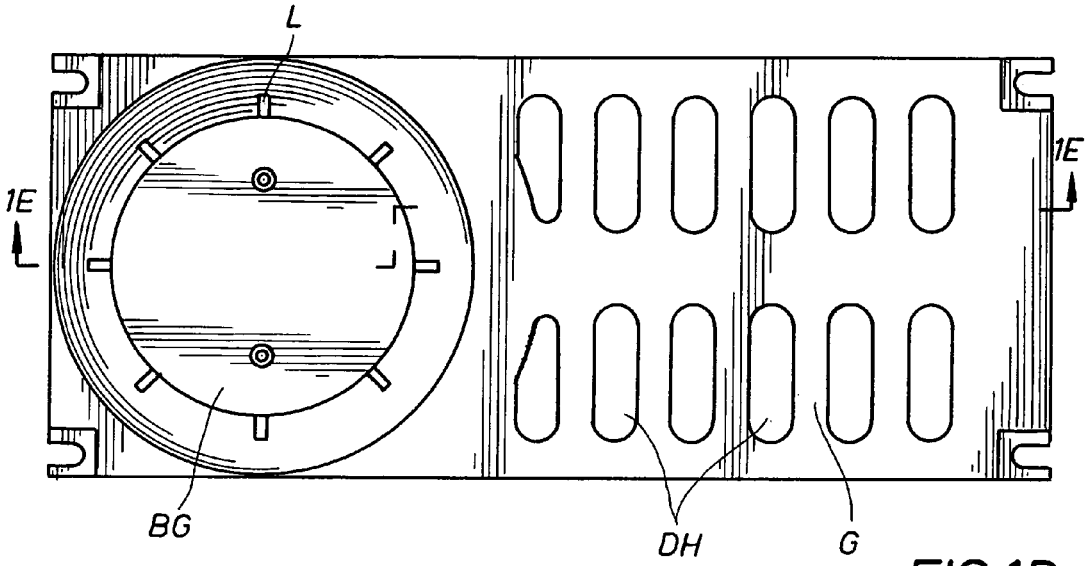

FIG. 1 illustrates an assembly of a preferred embodiment of a drain nozzle for an aircraft hangar. FIG. 1 is best reviewed in conjunction with FIG. 2 which offers an exploded isometric view of the same assembly of FIG. 1. As can be seen in FIG. 2 the assembly is comprised of essentially five pieces or elements: 1) grating G; 2) with separable bafflehead portion BG of grating G; 3) nozzle body or barrel NB; 4) height adjusting ring HAR; 5) and stream straightener SS.

Figure 2:
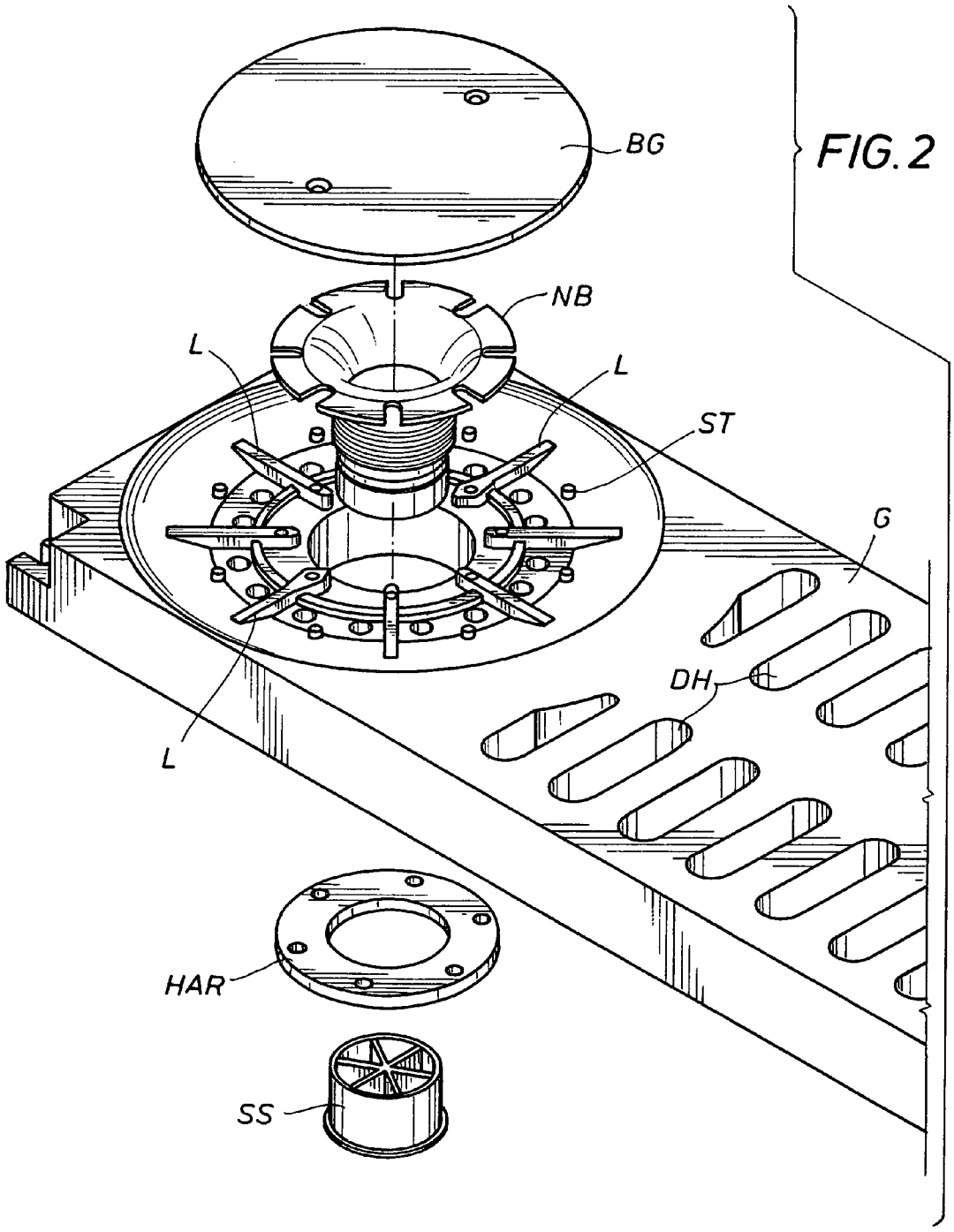
FIG. 2. is an exploded isometric view of the nozzle of FIG. 1.
Figure 3A:
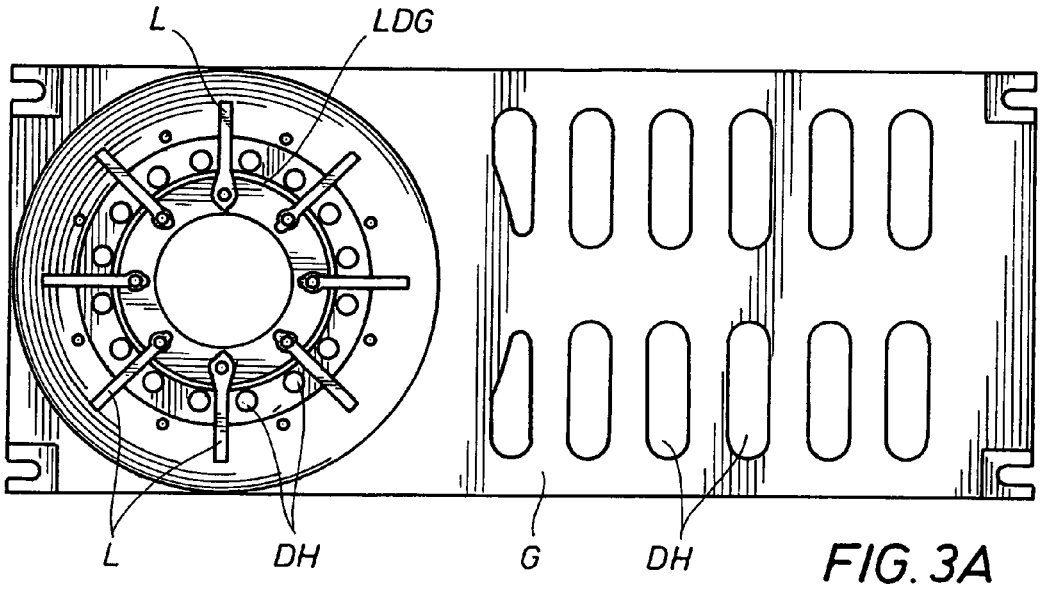
Figure 3B:
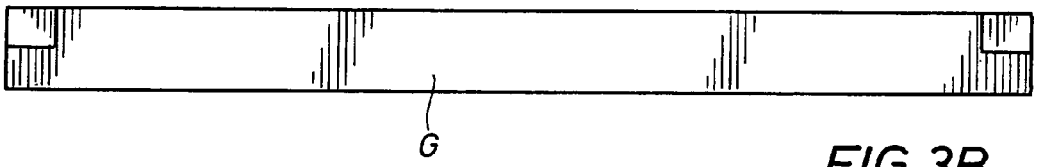
Figure 3C:
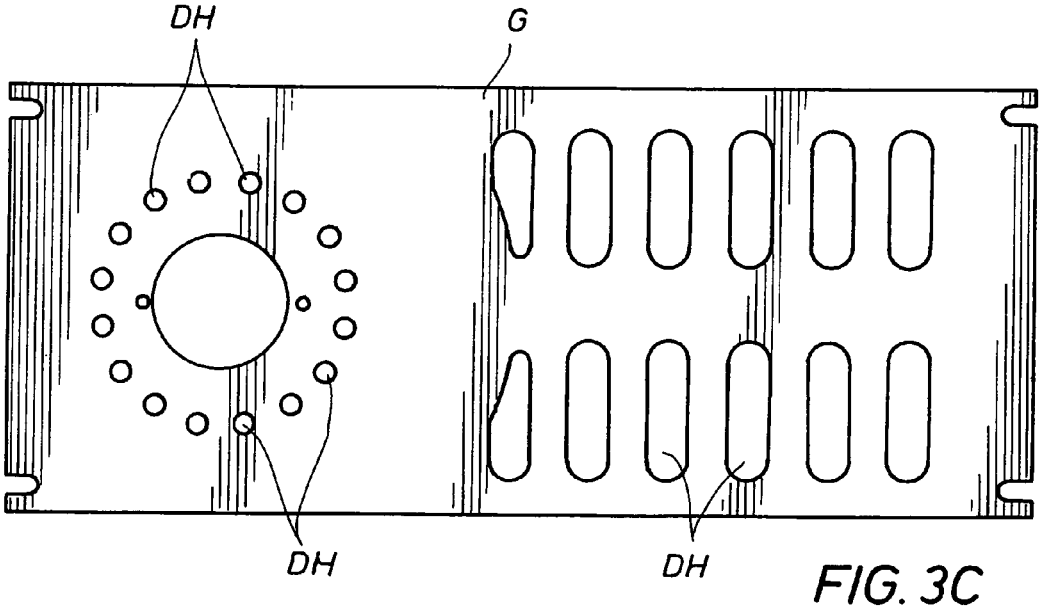

Stream straightener SS, FIG. 7, is press fit into the lower portion of nozzle body NB in a manner known and appreciated in the art, to yield improved nozzle discharge. Height adjustment ring HAR, FIG. 6, adjusts into position under the bottom of grating G as illustrated better in FIGS. 1 and 2. Nozzle body NB is preferably provided with lower external threads that screw into internal threads of the inside of height adjustment ring HAR. Screw holes are provided, as illustrated in FIG. 3, in the bottom of grating G such that the height adjustment ring can attach to the bottom of grating G in six different positions, providing flexibility for the adjustment of the height of nozzle NB with respect to the grating G and bafflehead BG. Bafflehead BG attaches by screws at two positions to ledges L, FIGS. 1, 2 and 3, provided on the grating to support the bafflehead BG. Further, round stobs ST of grating G, FIG. 2, also support bafflehead BG.

Bafflehead BG could be molded and produced in one piece with grating G. However, in the aircraft hanger embodiment, users of the drain nozzle explicitly wish to be able to remove any covering over the nozzle body and access the equipment below the grating therethrough. Hence the bafflehead is part of the grating but constructed in the order of a removable manhole cover.

Nozzle body NB, as more clearly disclosed in FIGS. 5 and 6, attaches to height adjusting ring HAR. Nozzle body NB in the preferred embodiment of the figures does not otherwise touch the grating, including the bafflehead portion of the grating.

Figure 1E:
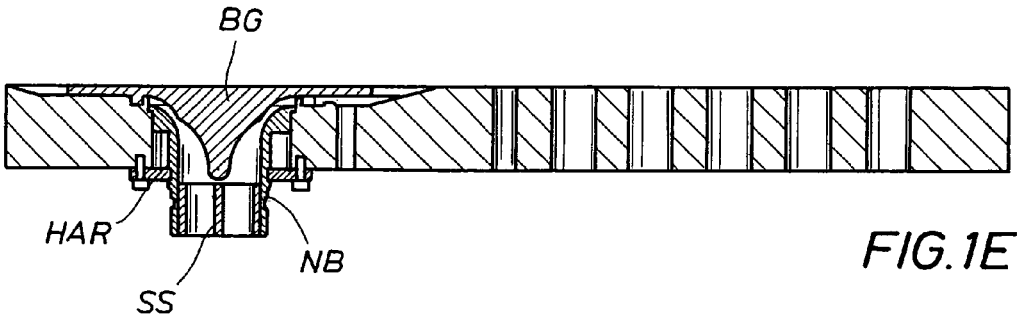
Figure 1F:
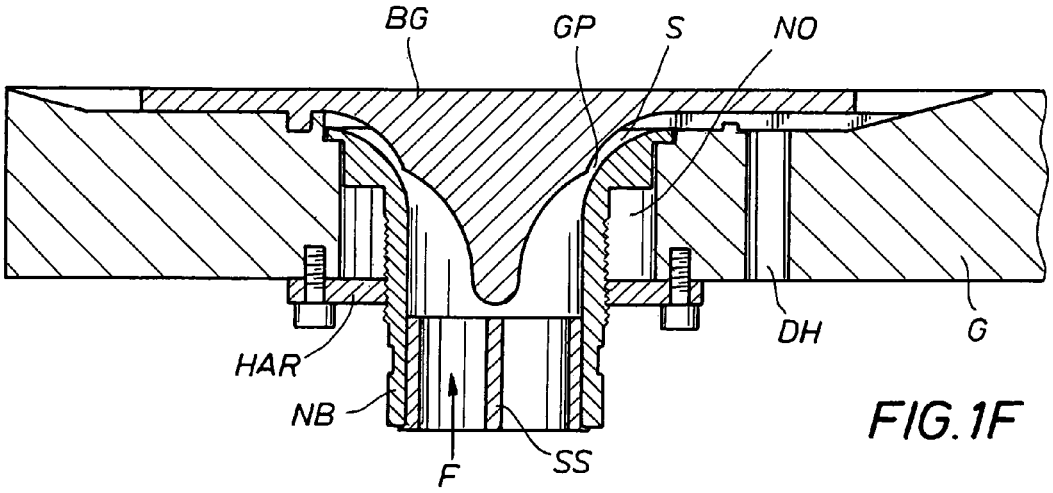

FIGS. 1E and 1F illustrate a cross section to the assembly of the stream straightener, nozzle barrel, height adjustment ring, grating and bafflehead portion of grating. FIG. 1 also illustrates two types of drain holes DH provided to drain fluid through the grating. The drain holes located in a circle in the region under the bafflehead portion of the grating are arranged to specifically drain foam from the nozzle barrel when the discharge portions of the grating are covered up. Arrows F in FIG. 1A illustrate the discharge pattern of the foam as dictated by the structure of the grating and the bafflehead portion of the grating.

FIG. 3 illustrates in greater detail just the grating without the bafflehead portion. Ledge LDG is particularly visible. A function of ledge LDG is to assist draining foam back into drain holes DH provided under the bafflehead BG.

Figures 4A, 4B, 4C, 4D, 4E:
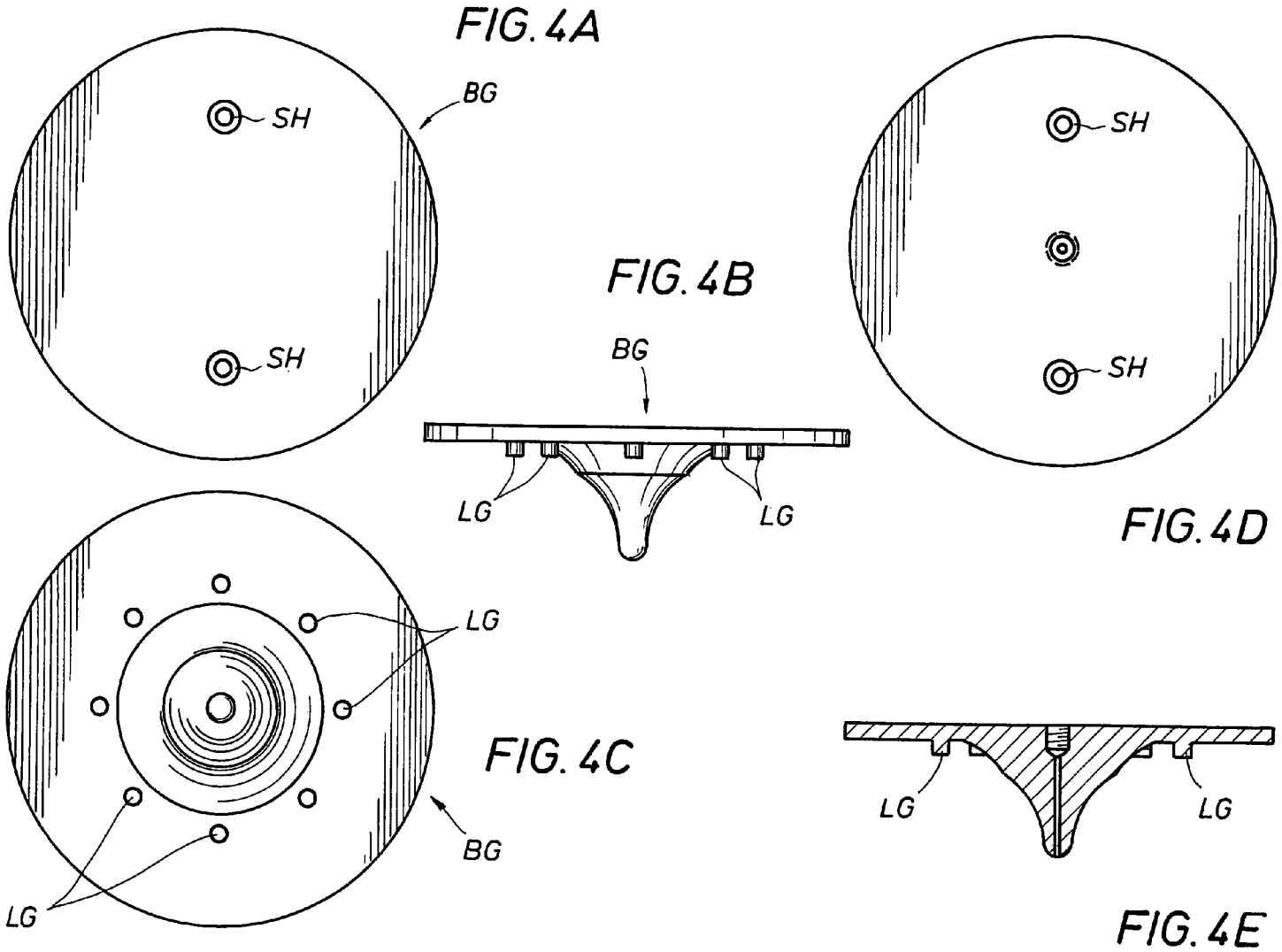
FIGS. 4A-4E provide views of the bafflehead portion of the grating of FIG. 1, including top, side, top detail and side cutaway views, respectively.

FIG. 4 illustrates, especially in the cross section of the bafflehead, that the bafflehead contains, in the preferred embodiment, six downwardly projecting lugs LG. The lugs fit into lug holes LGH illustrated in FIG. 3. The lug holes LGH are in the inside end of the landings L.

FIG. 3 also illustrates the eight stobs ST that rise up like the landings to help support the bafflehead portion BG.

One function of the lugs LG and the lug holes LGH on the bafflehead and grating respectively is to help the bafflehead resist torque forces or rotation or twisting. In two locations the bafflehead will form a screwed connection with holes SH of the landings L as illustrated in FIG. 3.

FIG. 4 also illustrates in the bafflehead an optional pressure tap configuration. The bafflehead of FIG. 4 contains a tapped hole in which a pressure instrument can be inserted in order to optimize the operation of the system.

FIG. 5 illustrates the nozzle body or barrel with notched flange for fitting around the landings L. In operation in preferred embodiments the nozzle body is supported by the height adjustment ring HAR. The nozzle body does not rest upon any portion of the grating. Further, the nozzle body does not touch at any place the bafflehead portion of the grating.

Figure 6D:
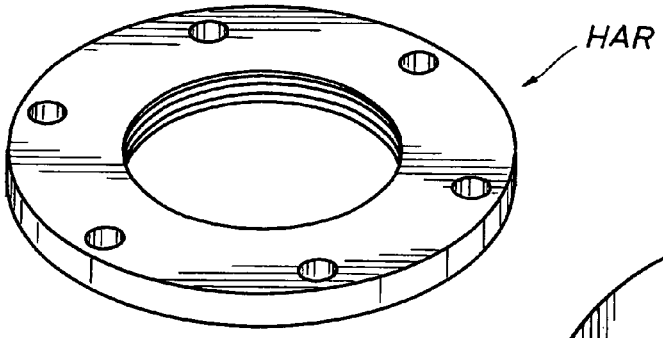
FIGS. 6B-6D illustrate one height adjustment ring of the embodiment of FIG. 1 in top, perspective and side views.
Figure 6B:
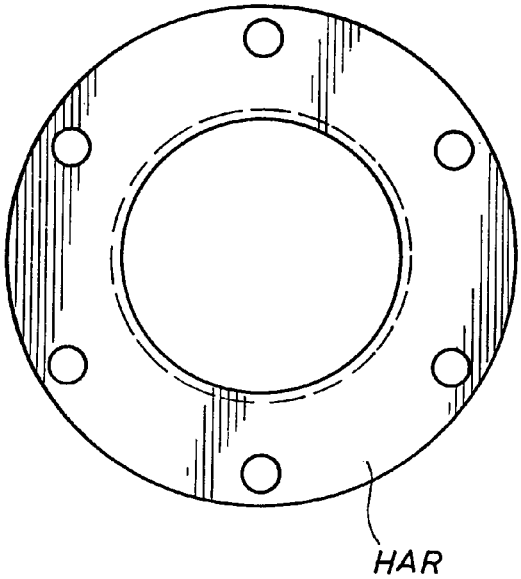
Figure 6C:
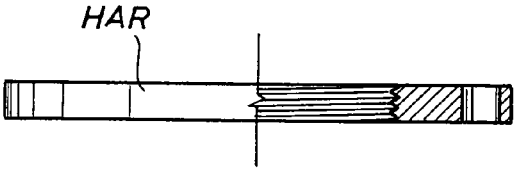
Figure 6A:
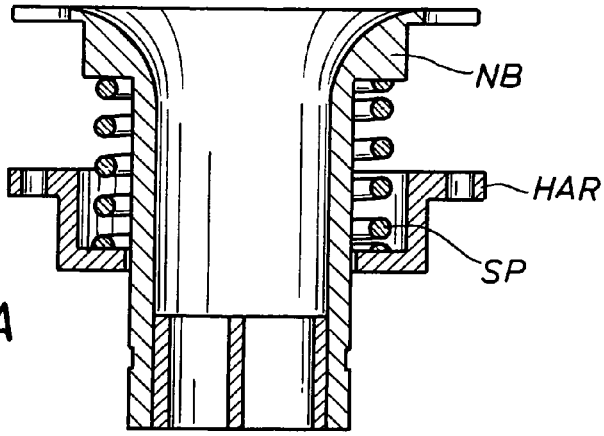
FIG. 6A illustrates an alternate pressure regulating height adjustment ring in cut-away.

As illustrated in FIG. 6 and FIG. 6A the height adjustment ring can be essentially a ring with provisions for attaching to the bottom of the grating at various points and an interior screw thread for adjustably mating with the nozzle barrel.

Alternate FIG. 6A illustrates that the height adjustment ring could have an extension that receives the bottom of the nozzle body on top of a spring SP held within a cup of the height adjustment ring. The function of the spring or other like biasing element would be to keep the nozzle body at a separation gap from the bafflehead such that the discharge pressure of the foam was a targeted amount.

The foregoing description of preferred embodiments of the invention is presented for purposes of illustration and description, and is not intended to be exhaustive or to limit the invention to the precise form or embodiment disclosed. The description was selected to best explain the principles of the invention and their practical application to enable others skilled in the art to best utilize the invention in various embodiments. Various modifications as are best suited to the particular use are contemplated. It is intended that the scope of the invention is not to be limited by the specification, but to be defined by the claims set forth below. Since the foregoing disclosure and description of the invention are illustrative and explanatory thereof, various changes in the size, shape, and materials, as well as in the details of the illustrated device may be made without departing from the spirit of the invention. The invention is claimed using terminology that depends upon a historic presumption that recitation of a single element covers one or more, and recitation of two elements covers two or more, and the like. Also, the drawings and illustration herein have not necessarily been produced to scale.

What is claimed is:

1. A drain nozzle system having a nozzle defining a predominant flow path for discharge of fluid for fire fighting, comprising:

a floor grating providing fluid drains structured to drain fluid through, and to below, the grating and defining a bafflehead of the nozzle, the bafflehead integrated into the floor grating;

a nozzle barrel, adjustably attachable to the floor grating, wherein adjustably attachable includes adjustable in the direction of flow;

the bafflehead and nozzle barrel defining an adjustable annular discharge gap therebetween within the predominant flow path; and the grating and nozzle barrel structured in combination such that the grating defines a passage in and through the grating for discharge from the nozzle barrel.

2. The drain nozzle system of claim 1 including the adjustable annular discharge gap structured to adjust to a plurality of fixed open positions.

3. The drain nozzle system of claim 2 wherein a height adjustment ring attaches the nozzle barrel to the grating and the k factor of the nozzle is adjustable by adjusting the ring.

4. The drain nozzle system of claim 3 wherein the discharge pressure of the predominant flow path is regulated by a biasing element between the height adjustment ring and the nozzle barrel.

5. The drain nozzle system of claim 1 wherein the grating provides a passage for foam discharge from the predominant flow path, the passage inclined significantly laterally and around 360 degrees.

6. The drain nozzle system of claim 1 wherein the bafflehead is removeably attachable to the grating.

7. The drain nozzle system of claim 3 including a constant pressure-biasing element interspersed between the height adjustment ring and the nozzle barrel such that the element expands and contracts to maintain a constant pressure on opposing barrel surface within a given range of adjustment.

8. The drain nozzle system of claim 1 wherein the grating and the bafflehead shape foam discharged from the predominant flow path into a substantially circular and lateral pattern.

9. The drain nozzle system of claim 1 wherein the bafflehead and nozzle barrel define an adjustable annular discharge gap therebetween with the bafflehead maintaining a fixed relationship with respect to the grating.

10. The drain nozzle system of claim 1 wherein the nozzle barrel, grating and bafflehead are structured in combination such that the nozzle barrel adjusts, in the direction of flow, with respect to the floor grating without affecting the relationship of the bafflehead with the floor grating.

11. The drain nozzle system of claim 1 wherein the nozzle barrel, the bafflehead, and the floor grating are structured in combination such that the nozzle barrel is not in direct contact with the bafflehead.

12. The drain nozzle system of claim 1 wherein the nozzle barrel, and the floor grating are structured in combination such that the nozzle barrel is not in direct contact with the floor grating.

13. The drain nozzle system of claim 1 wherein the bafflehead is constructed of the same material as the floor grating.

14. A drain nozzle system having a nozzle defining a predominant flow path for discharge of fluid for fire fighting, comprising:

a floor grating providing fluid drains structured to drain fluid through, and to below, the grating and defining a bafflehead of the nozzle, the bafflehead integrated into the floor grating;

a nozzle barrel, adjustably attachable to the floor grating, wherein adjustably attachable includes adjustable in the direction of flow;

the bafflehead and nozzle barrel defining an adjustable annular discharge gap therebetween within the predominant flow path; and the grating providing a fluid drain under the bafflehead structured to drain fluid to below the grating while discharging through the predominant flow path of the nozzle.

15. A drain nozzle system having a nozzle defining a predominant flow path for discharge of fluid for fire fighting, comprising:

a floor grating providing fluid drains structured to drain fluid through, and to below, the grating and defining a bafflehead of the nozzle, the bafflehead integrated into the floor grating;

a nozzle barrel, adjustably attachable to the floor grating, wherein adjustably attachable includes adjustable in the direction of flow;

the bafflehead and nozzle barrel defining an adjustable annular discharge gap therebetween within the predominant flow path; and wherein the fluid drains are structured to drain fluid past the nozzle barrel while discharging through the predominant flow path of the nozzle.

16. The drain nozzle system of claim 14 including the adjustable annular discharge gap structured to adjust to a plurality of fixed open positions.

17. The drain nozzle system of claim 15 including the adjustable annular discharge gap structured to adjust to a plurality of fixed open positions.

18. The drain nozzle system of claim 14 wherein the nozzle barrel, the bafflehead and the floor grating are structured in combination such that the nozzle barrel is not in direct contact with the bafflehead.

19. The drain nozzle system of claim 15 wherein the nozzle barrel, the bafflehead and the floor grating are structured in combination such that the nozzle barrel is not in direct contact with the bafflehead.

* * * * *